United States Patent [19]

Ishizuka et al.

[11] Patent Number: 4,593,522

[45] Date of Patent: Jun. 10, 1986

[54] METHOD AND APPARATUS FOR PRODUCING SPUN YARN

[75] Inventors: Yasuhiro Ishizuka; Takashi Nakayama; Seiichi Yamagata, all of Otsu, Japan

[73] Assignee: Toray Industries, Inc., Tokyo, Japan

[21] Appl. No.: 500,441

[22] Filed: Jun. 2, 1983

[30] Foreign Application Priority Data

Jun. 3, 1982 [JP] Japan ..... 57-95212

[51] Int. Cl.[4] ..... D01H 1/135; D01H 7/885; D01H 7/892

[52] U.S. Cl. ..... 57/400; 57/401; 57/404; 57/408

[58] Field of Search ..... 57/400, 401, 404, 408, 57/413, 414

[56] References Cited

U.S. PATENT DOCUMENTS

| | | | |
|---|---|---|---|
| 2,732,682 | 1/1956 | Kyame | 57/408 X |
| 2,926,483 | 3/1960 | Keeler et al. | 57/408 X |
| 3,110,150 | 11/1963 | Kyame et al. | 57/408 X |
| 3,132,465 | 5/1964 | Putnam | 57/409 X |
| 3,295,307 | 1/1967 | Kyame et al. | 57/408 X |
| 3,343,360 | 9/1967 | Brown | 57/401 |
| 3,468,116 | 9/1969 | Crandall et al. | 57/404 X |
| 3,611,695 | 10/1971 | Brown | 57/401 |
| 4,044,537 | 8/1977 | Negishi et al. | 57/404 X |

FOREIGN PATENT DOCUMENTS 411862 7/1934 United Kingdom .

*Primary Examiner*—John Petrakes

*Attorney, Agent, or Firm*—Quaintance, Murphy & Presta

[57] ABSTRACT

An apparatus and method for producing a spun yarn having true twist comprising extracting staple fibers from a bundle of staple fibers; and collecting the extracted staple fibers on the periphery of a spinning rotor; and recontacting the extracted fibers with the bundle of staple fibers to form a combined untwisted yarn; and twisting the combined untwisted yarn to produce a twisted yarn; and withdrawing the twisted yarn from the spinning rotor.

14 Claims, 13 Drawing Figures

(INVENTIVE)

METHOD AND APPARATUS FOR PRODUCING SPUN YARN

BACKGROUND OF THE INVENTION

The present invention relates to a method and apparatus for producing spun yarn having a real twist.

For over a century, the ring traveller method has played a leading part in the art of producing spun yarns. With the recent increase in labor and energy costs, however, research and development efforts have been made to provide more efficient and innovative methods for producing spun yarns, in an attempt to replace the ring traveller method wherein operation involves low productivity and considerable electric power consumption on the order of 60 to 80% of the total power requirements for the entire spinning process.

Typical of such innovative methods is the one known as the rotor-type open end spinning method. This method permits more than three times as high a rate of production as does the ring-traveller method. As a more recent development, a method known as the fasciated yarn spinning method is now available. This method permits a still higher range of spinning velocities, on the order of 100 to 200 m/min. As far as rate of production is concerned, truly remarkable progress has been made in the last decade.

As regards end uses of spun yarns produced by these innovative processes, certain markets have been developed which can best utilize the characteristic features of these yarns. However, these yarns, in their present form, are not suitable for replacement of ring spun yarns. They are substantially different from ring spun yarns in yarn structure and properties, and unlike ring spun yarns, they lack general-purpose properties. Accordingly, their end uses are limited.

In order to further quantity-wise expansion and development in use of such innovative yarns, therefore, it is most important that there must be improvements well adapted for general-purpose uses, not to speak of the necessity of such high rate of production to be maintained as at present. To this end, it is necessary that they must have a structure similar to ring spun yarn, that is, a yarn structure having good fiber arrangement and evenly distributed twist. Indeed, a process which could permit production of a yarn having such a structure at an economically feasible rate and on a high volume basis would possibly replace the ring spinning method which involves rather inefficient operation.

In addition to the ring-traveller method, there is another established spinning method known as the tufted twisting method, which can produce spun yarns having real twist and relatively good fiber arrangement.

In this method a roller-drafted sheaf of staple fiber bundle is tufted by intermittent drafting. Tufts, which represent a small mass of staple fibers drawn out of said staple fiber bundle, so formed are sequentially superimposed on fiber ends being twisted by the rotation of a rotating spindle. In this manner a spun yarn having real twist is produced.

According to this technique, a spun yarn having a complete form of real twist can be obtained. However, there is a limitation that one turn is given for each turn of the rotating spindle. Therefore, if an economical spinning velocity is to be obtained, it is necessary to increase the rotational speed of the rotating spindle. The problem here is that if the spinning velocity is increased, fibers adjacent the rotating spindle may fly away under centrifugal force and the fiber arrangement may be disturbed. These adverse effects limit the spinning velocity. Therefore, in order to utilize this technique it is essential that the number of turns imparted by the rotation of the rotating spindle should be increased and that means should be provided to prevent any possible adverse effect of centrifugal force.

DESCRIPTION OF THE PRIOR ART

In the art to which the present invention is directed there are various known methods, such as the Barker method invented by Dr. Barker et al, of the United Kingdom, in 1933 and the Southern Regional Research Laboratory (SRRL) method developed in the U.S.A. The SRRL method is an improvement based on the principle of the Barker method. Among other known methods are those disclosed in United Kingdom Specification No. 411,862, and in U.S. Pat. Nos. 2,732,682; 2,926,483; 3,110,150; and 3,295,307. In the following description of the prior art, the Barker method, a technique most similar to the concept of the present invention, is referred to by way of example.

The yarn formation mechanism employed in the Barker method comprises a rotating spindle and an anvil roller adapted to rotate at the same peripheral speed as the spindle. The rotating spindle has a narrow grooved contact-surface area provided on a part of its periphery. On the forward side of the rotating spindle, adjacent the contact surface area, there is provided a yarn guide hole extending radially inwardly into the spindle. The yarn guide hole communicates with a yarn draw hole bored along the axis of the spindle.

The rotating spindle and the anvil roller are adapted to go into surface contact with each other through the surface contact area.

When a roving or sliver is fed between the rotating spindle and the anvil roller, a part of the fiber masses forming the roving or sliver is grasped between the spindle and the anvil roller as they come in surface contact, being thus extracted. The extracted fibers are guided into the yarn guide hole in front of the contact surface area. They are given twist at the rate of one turn for each turn of the rotating spindle, and are subsequently drawn through the yarn guide hole. Each time said surface contact is repeated, fibers are extracted and brought in partially overlapping relation with previously extracted fibers while being held in contact with the peripheral surface of the spindle. They are then guided into the yarn guide hole in which they are subject to twisting until they are drawn in spun yarn form from the yarn draw hole. The spun yarn so drawn is subsequently wound into a package.

As compared with other open-end spinning methods, this method is advantageous in that the yarn produced involves less irregularity in fiber arrangement and has a structure similar to that of a ring-spun yarn. The yarn therefore has better hand, strength and luster.

As mentioned above, however, the method has a limitation that only one turn is given for each turn of the rotating spindle. Therefore, if the method is to be economically practiced, it is necessary that the rotating spindle be operated at high speed. In this connection, the difficulty is that fibers adjacent the rotating spindle are liable to be blown in. This is a cause of irregular fiber arrangement. Where a short fiber material such as cotton is used, this method involves no problem with yarn formation. Sheaves of fiber bundle held between the rotating spindle and the anvil roller can readily be pulled out and led continuously into the yarn guide hole. However, where a long fiber material for worsted spinning is used, there is a difficulty that if the rotating spindle and the anvil roller are rotated, with the front end of a sheaf of fiber bundle therebetween, fibers are shifted only over the length of the contact surface area. The rear end of the held fibers may not be pulled off. This inhibits continuous delivery of fibers into the yarn guide hole. Accordingly, continuous yarn formation is not practicable. For the above and other reasons, tufted twist spinning techniques have not been employed on an industrial scale.

SUMMARY OF THE INVENTION

It is an object of the present invention to provide a method for producing a spun yarn having real twist which eliminates the drawbacks of the conventional tufted twist spinning method and which permits a plurality of turns to be given to the fibers for each turn of the spinning rotor so that a spun yarn having real twist, of same quality level as a ring-spun yarn, can be produced on an economically stable basis.

It is another object of the invention to provide an apparatus for practicing said method.

The present invention provides a method for producing a spun yarn having real twist by drawing staple fibers out of a staple fiber bundle and giving real twist on it. The method utilizes a ring-shaped or disc-like spinning, rotor. Fibers are drawn out of the staple fiber bundle with an outer peripheral surface of the spinning rotor while it is rotating, accumulating at least a part of said staple fibers drawn out on a rotating yarn end on said peripheral surface, withdrawing a twisted yarn through a yarn path connected between said peripheral surface and an inner central portion of the spinning rotor, and false-twisting it on the downstream side of the outer peripheral surface of the spinning rotor.

The invention also provides an apparatus for producing a spun yarn having real twist, which has a ring-shaped or disc-like spinning rotor provided between a feeding mechanism and a delivery mechanism. The apparatus is adapted to draw a sheaf of staple fibers through a yarn path connected between the outer peripheral surface and an inner central portion of the spinning rotor to obtain a spun yarn. The apparatus has a fixed nip point for nipping a bundle sheaf of staple fibers. A movable nip point is provided on the outer peripheral surface of the spinning rotor. A false-twisting spindle is provided on the downstream side of the peripheral surface relative to the movable nip point.

In the present invention, two or more turns are produced on the fibers for each turn of the spinning rotor. In the prior art, only one turn per turn of the rotor is conventional. Therefore, by employing the method and apparatus of the present invention, it is possible to obtain these advantages: improved spinning velocity, saving in energy consumption, and economical production of spun yarns having real twist.

BRIEF DESCRIPTION OF THE DRAWINGS

The invention may be better understood by reference to the following drawings wherein.

PREFERRED EMBODIMENTS

Figure 2:
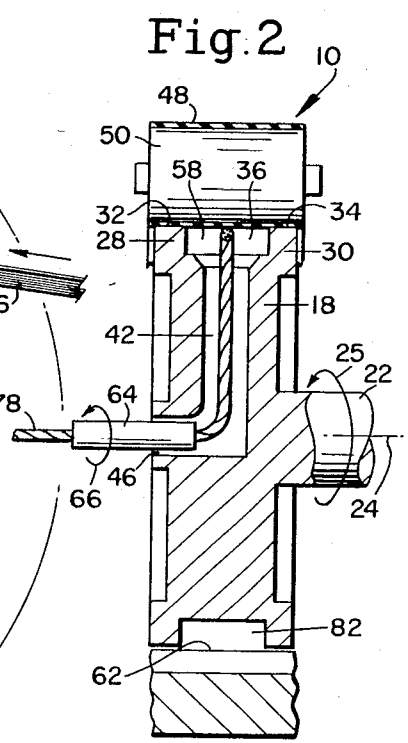
FIG. 2 is a sectional view taken along Line 2—2 of FIG. 1.
Figure 1:
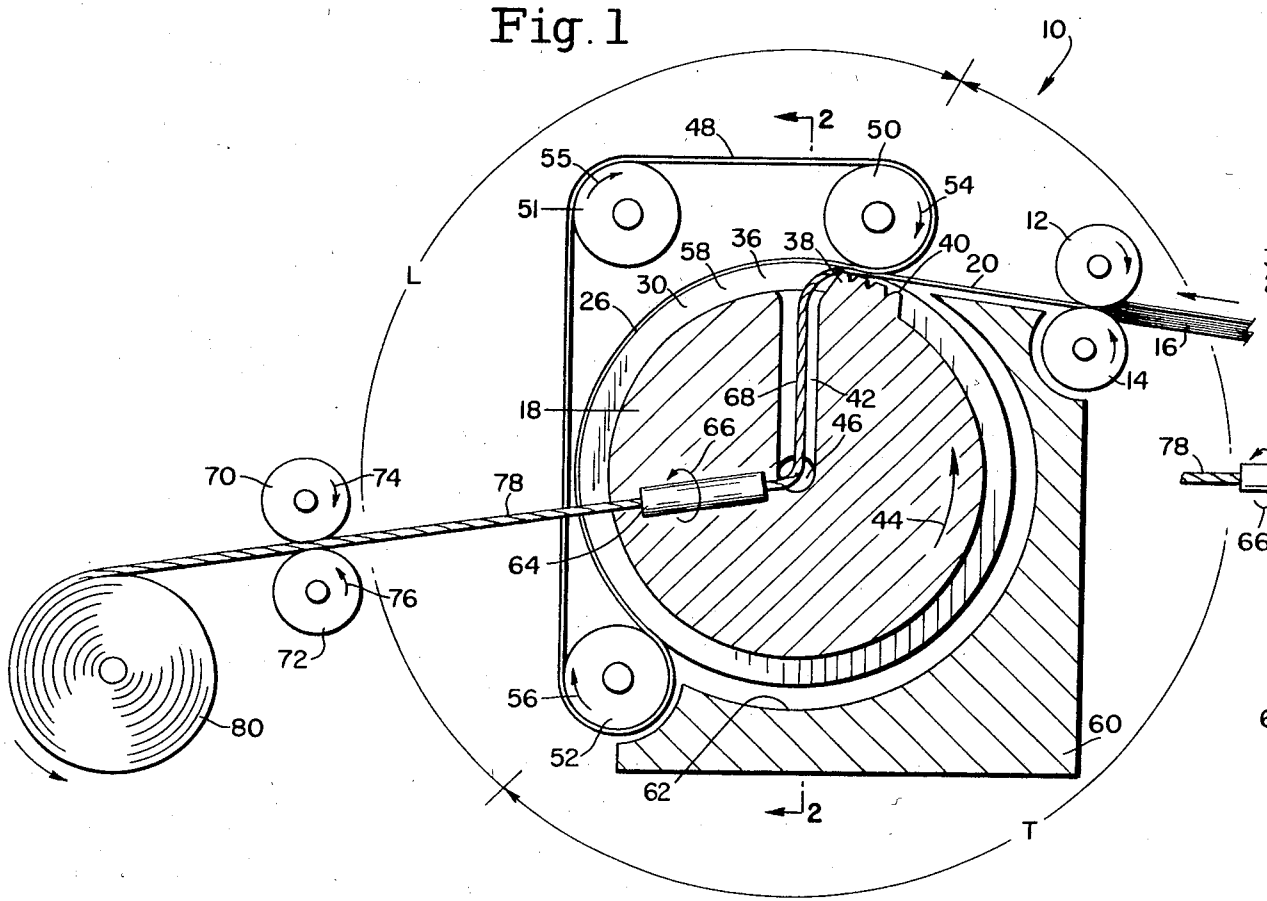
FIG. 1 is a schematic sectional view of one embodiment of the present invention.

Referring now to the drawings in general and in particular to FIGS. 1 and 2, there is shown an apparatus 10 for producing spun yarn having both true twist and false twist. The apparatus 10 has nip rollers 12,14 which constitute a first pair of nip rollers and which form a first stationary nip. The nip rollers 12,14 are adapted to contact a bundle 16 of fibers and advance the bundle 16 of fibers towards a rotor 18. After the bundle 16 passes between the nip rollers 12,14, it becomes a flat bundle 20. The rotor 18 has a shaft 22 which is adapted to be connected to a motor (not shown) which motor constitutes a means for rotating the rotor 18 about its axis 24 in the direction of the arrow 25. The periphery 26 of the rotor 18 has walls 28,30. The wall 28 terminates in a cylindrical outer surface 32, whereas the wall 30 terminates in a cylindrical outer surface 34. The cylindrical outer surface 32 is coincidental with the cylindrical outer surface 34. The walls 28,30 define an annular groove 36 which is interrupted by a boss 38. The boss 38 has an outer, yarn-engaging surface 40. The rotor 18 has a radial passage 42 adjacent the boss 38 in the direction of movement of the rotor 18 shown by the arrow 44. The radial passage 42 is in communication with an axial passage 46. The axial passage 46 exits the rotor 18 on the side of the rotor 18 opposite the shaft 22.

The apparatus 10 is also provided with an endless belt 48 which moves about rollers 50,51,52 which turn in the directions of arrows 54,55,56. The endless belt 48 contacts the cylindrical upper surface 32 of the wall 28 and also contacts the cylindrical upper surface 34 of the wall 30, thereby forming a fiber-tight chamber 58. The endless belt 48 contacts the yarn-engaging surface 40 of the boss 38 and forms an arcuately moving nip which moves from the first point of attachment between the boss 38 and the endless belt 48 to the last point of attachment between the boss 38 and the endless belt 48. This last point of attachment occurs when the boss 38 is adjacent to the roller 52. The length of contact "L" of the endless belt and the boss 38 measured between a point adjacent to the roller 50 around the periphery 26 of the rotor 18 ending adjacent to the roller 52 is significant. The length of contact "L" is greater than the average length of the fibers in the bundle 16,20.

The apparatus 10 is also provided with a casing 60 having a cylindrical surface 62 closely adjacent the cylindrical upper surfaces 32,34 of the walls 28,30 of the rotor 18. The surface 62 of the casing 60 covers that portion of the periphery 26 of the rotor 18 which portion is free of the endless belt 48.

The apparatus 10 is also provided with a false twister 64 adapted to rotate in the direction of the arrow 66 by means not shown. The false twister 64 imparts false twist to the yarn 68. As shown in FIG. 2, the false twister 64 is located within the axial passage 46. The position of the false twister 64 is accurately shown in FIG. 2. For clarity, the position of the false twister 64 in FIG. 1 is shown out of position.

The apparatus 10 is also provided with nip rollers 70,72 which rotate in the direction of the arrows 74,76. The pair of nip rollers 70,72 withdraw the spun twisted yarn 78 from the rotor 18. Means (not shown) are provided for forming the yarn 78 into a roll 80.

The surface 62 of the casing 60 and the annular groove 36 together form a chamber 82 which is contiguous with the chamber 58 and forms a continuous fiber-tight chamber defined by the annular groove 36, the endless belt 48, the cylindrical surface 62 of the casing 60 and the boss 38.

Figure 3:
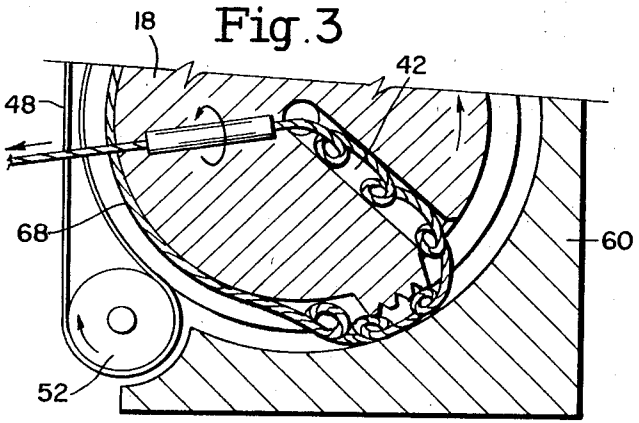
FIG. 3 is a view of the embodiment of FIG. 1 with the rotor in a different position.

FIG. 3 shows the rotor 18 with the boss 38 adjacent to the casing 60.

Figure 4:
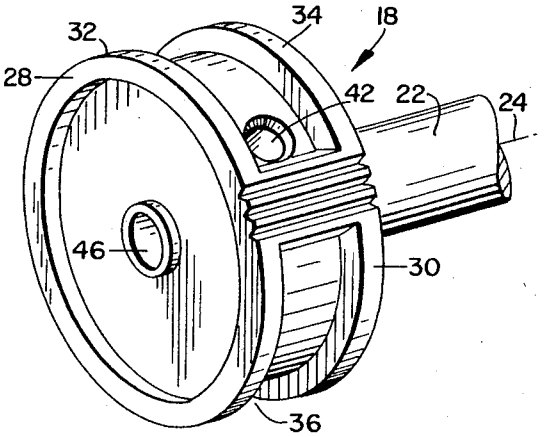
FIG. 4 is an isometric view of the rotor of FIGS. 1, 2 and 3.

FIG. 4 is an isometric view of the rotor 18.

In operation, the bundle 16 of fibers is advanced by the pair of nip rollers 12,14 to form a flat bundle 20. The flat bundle 20 is caught between the arcuately moving nip formed between the surface 40 of the boss 38 and the endless belt 48. This contact of the surface 40 with the belt 48 extracts fibers from the bundle 20, leaving the fibers in the chamber 58. The extracted fibers are collected in the chambers 58,82 and are then recontacted with the bundle 20 to form a combined untwisted yarn. The combined untwisted yarn is then twisted and then withdrawn from the spindle 18 by drawing the yarn 68 through the passages 42,46 by means of the nip rollers 70,72. The fibers in the chamber 58,82 contact the fiber bundle 20 after the fiber bundle 20 leaves the first pair of nip rollers 12,14 and before the fiber bundle 20 contacts the endless belt 48.

In order to permit efficient drawing of staple fibers, the stationary nip between the nip rollers 12,14 is preferably spaced away from the moving nip between the boss 38 and the endless belt 48 by a distance that is greater than the mean length of the staple fibers. As an alternative, known fiber transfer means (not shown), such as an apron, plate, aspirator, air false-twisting nozzle, roller, or other mechanism, can be provided between the nip rollers 12,14 and the endless belt 48. The addition of such a transfer means is desirable in certain cases because it permits accurate transfer of fibers.

The term "moving nip point" as used herein means a nip point represented by the contact between the belt 48 and the boss 38. That part of the periphery 26 of the rotor 18 which has no endless belt is covered by the surface 62 of the casing 11.

Staple fibers held between the boss 38 and the belt 48 are moved along the length of the belt 48. In this manner, they are held such that they are extracted from the bundle 20 and are brought into partially overlapping relation with the yarn 68 and the bundle 20. The extracted fibers are drawn into the radial passage 42 and are guided through the axial passage 46 into the false twister 64. In the false twister 64, the extracted fibers are given a false twist at the rate of "n" turns for each turn of the rotor 18, if the false twister 64 is rotated at a rate of "n" rpm for each turn of the spinning rotor 18.

When the extracted fibers are removed from the belt 48, their ends are kept in rotating condition until they are brought into contact once again with the belt 48 over the distance "T". During their passage through the distance "T", the fibers are turned around under the rotating force of the false twister 64. In this manner, the extracted fibers are given true twist.

In addition, the open ends of the fibers are given adequate tension under centrifugal force produced by rotation of the rotor 18. In this manner, they are positioned slightly apart from the periphery 26 of the rotor 18. This occurs in the chamber 82 without their being permitted to slip into crimped form into the radial passage 42. Accordingly, the opened ends of the fibers are little subject to damping force against their turning. They are, therefore, readily given twist. Hence the number of rotations of the false twister 64 in the "T" zone constitutes the number of twists "N" which can be expressed by Formula I:

$$N = \frac{nT}{L + T}. \quad \text{(I)}$$

This means that one turn of the rotor 18 produces a twist effect of (1+N) turns with respect to the fibers.

For example, when the rotor 18 turns at 1,000 rpm, the false twister 64 turns at 20,000 rpm, and the length of the zone "T" equals one-half the peripheral length of the rotor 18, twist will be given at the rate of (1+10) turns for each turn of the spinning rotor 18.

Successively as contact between the belt 48 and the boss 38 is repeated, fibers are extracted. The extracted fibers are brought in partially overlapping relationship with the previously extracted fibers. In this manner, they are led into the axial passage 42. After they pass through the axial passage 42 and the false twister 64, they are led from the rotor 18 through nip rollers 70,72.

In certain circumstances, the actual number of twists may be smaller than the values given above. This is because some loss of twist may be caused by frictional resistance in the passage 42 and because of the false twist given in the zone of contact between the belt 48 and the boss 38 which is more or less subjected to untwisting in the zone "T".

There are several ways to minimize the loss of the twist effect. One way is to provide a length of contact between the belt 48 and the periphery 26 of the rotor 18 over as short a distance as practical. Another way is to provide a false twister disposed adjacent to the passage 42. Still another way is to increase the diameter of the passage 42.

In the case of relatively short fibers, such as those of cotton, the endless belt 48 need not be employed. In such a case, the rollers 50,51,52 may contact the rotor 18 directly. The peripheral surface of the rotor may be covered with a casing. With such an arrangement, it is possible to obtain satisfactory yarn formation.

The endless belt 48 can be adapted for tension adjustment by changing the distance between any two rollers, such as the rollers 50,51. The endless belt 48 moves at the same velocity as the periphery 26 of the rotor 18. The length of contact "L" between the endless belt 48 and the boss 38 is generally greater than one inch.

The rotor 18 can have a ring-like configuration or a disc-like cohfiguration.

Figure 5:
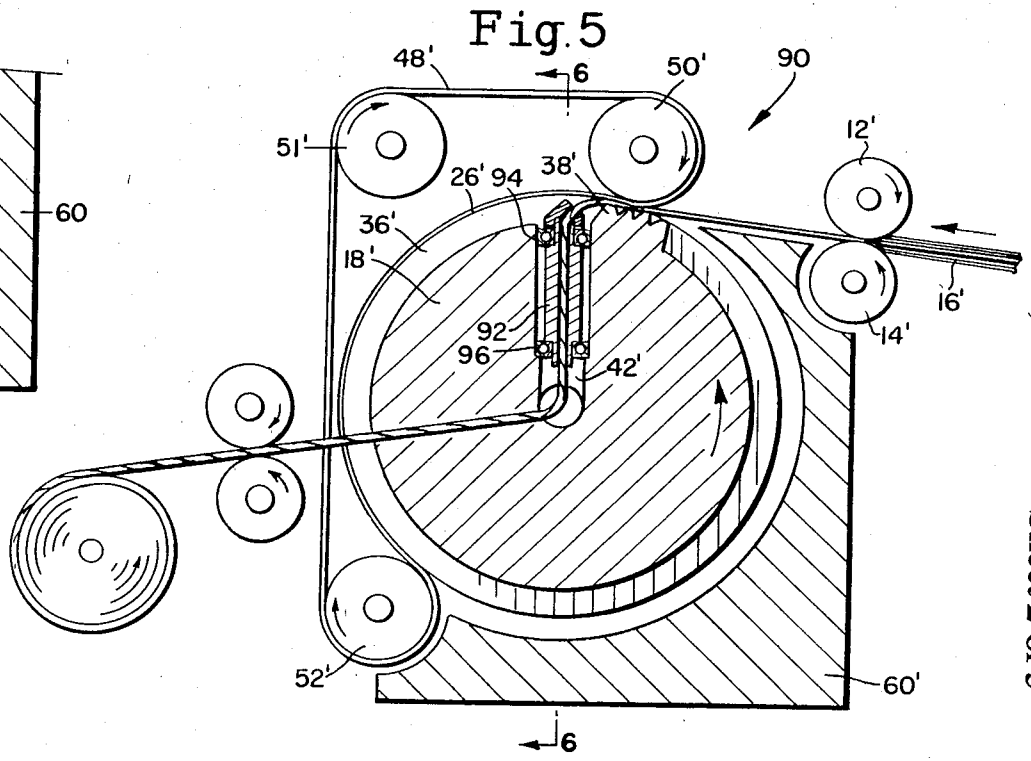
FIG. 5 is a schematic view of a different embodiment of the present invention.
Figure 7:
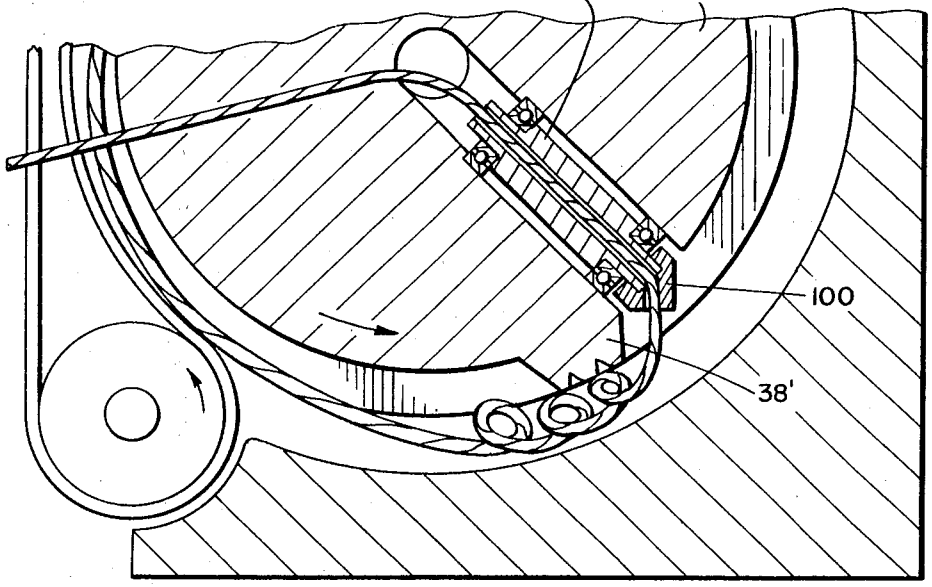
FIG. 7 is a partial sectional view of the embodiment of FIG. 5 but with the rotor in a different position.
Figure 6:
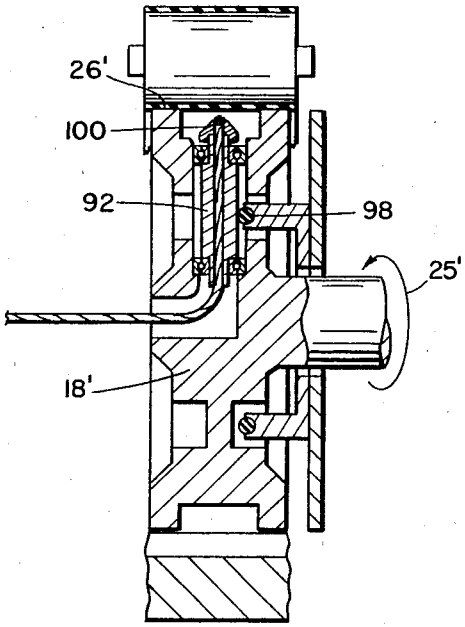
FIG. 6 is a sectional view taken along Line 6—6 of FIG. 5.

Referring now to FIGS. 5, 6 and 7, there is shown an embodiment of the present invention in the form of an apparatus 90. The apparatus 90 is similar in many respects to the apparatus 10. The apparatus 90 comprises nip rollers 12',14' which receive a bundle 16' and feed it to a rotor 18'. The rotor 18' is provided with an annular groove 36', a boss 38', an endless belt 48', rollers 50',51',52' and a casing 60'. The rotor 18' has a radial passage 42'. Within the radial passage 42' is a false twister 92. The apparatus 90 exhibits certain advantages when compared to the apparatus 10. In the apparatus 90, the false twister 92 is located within the rotor 18'. In the apparatus 90, factors which may act against transference of twist are minimized so that the fiber ends can easily be turned around. Furthermore, twist efficiency is enhanced.

The false twister 92 is mounted in the passage 42' by means of bearings 94,96. The false twister 92 is adapted to rotate while being kept in pressure contact with a ring 98 (see FIG. 6). The ring 98 functions as a stationary friction element. The number of turns of the false twister 92, for each turn of the rotor 18', is expressed as the ratio of the diameter "D" of the ring 98 divided by the diameter "d" of the false twister 92. The number of twists can be increased by rotating the ring 98 in a direction opposite to the direction of rotation of the rotor 18' as represented by the arrow 25'. This increases the ratio of the speed of the false twister 98 with respect to the speed of the spinning rotor 18'. It is also possible to increase the number of twists without using a false twister. In this case, the yarn itself is rotated by applying suitable conditions selected for this purpose.

Figure 11:
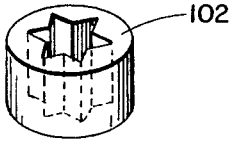
FIG. 11 is an alternative yarn outlet.
Figure 10:
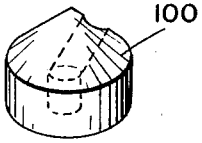
FIG. 10 is a isometric view of the yarn outlet shown in FIG. 7.

In order to improve fiber-end twist efficiency, it is preferable to provide the false twister 92 with a cap 100. The cap 100 is located adjacent to the periphery 26' of the rotor 18'. In this embodiment, the fiber ends are subject to a higher degree of turn so that any possible loss of twist is eliminated. Furthermore, twist transference efficiency is improved. The cap 100 is also shown in Figure 10. In FIG. 11, an alternative cap 102 is shown.

Figure 9:
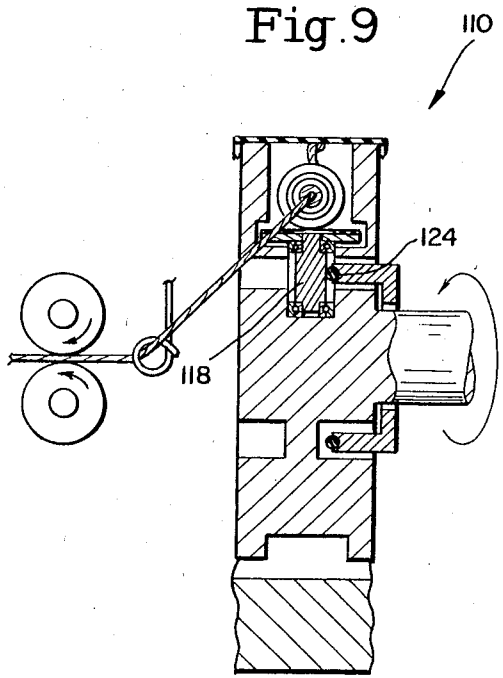
FIG. 9 is a sectional view taken along Line 9—9 of FIG. 8.
Figure 8:
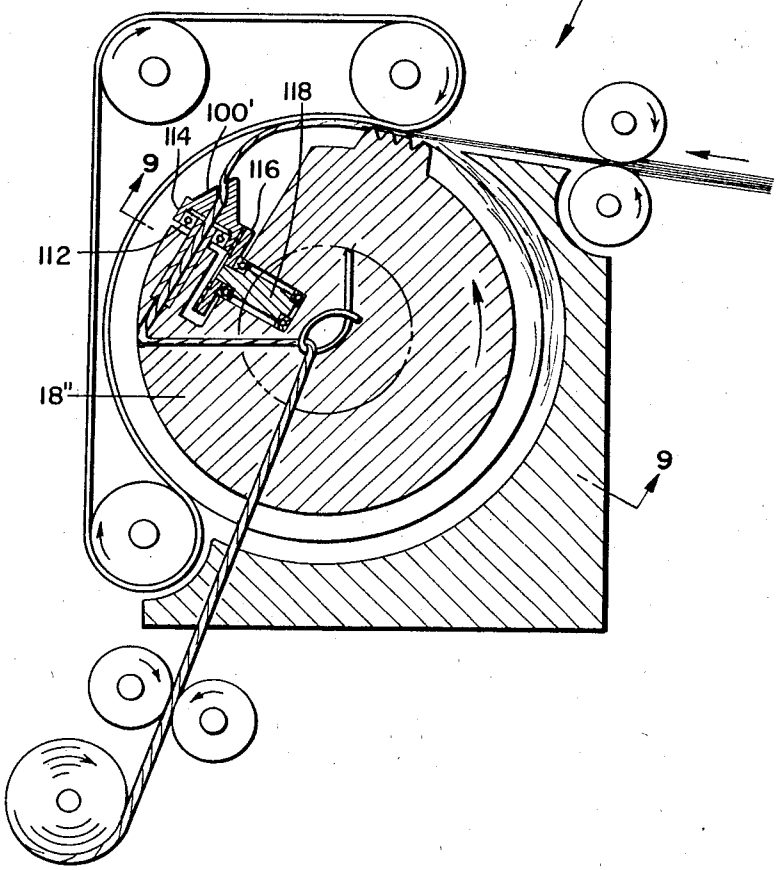
FIG. 8 is a partial sectional view of still another embodiment of the present invention.

Referring now to FIGS. 8 and 9, there is shown yet another embodiment of the present invention in the form of an apparatus 110. In the apparatus 110, the cap 100' is adapted to give twist effect to fiber ends. The cap 100' is carried by bearing 112. The surface 114 of the cap 100' is in abutting relationship with a disc 116. The disc 116 functions as a frictional element. The disc 116 is attached to the cylinder 118 which, in turn, is supported by bearings 120,122.

As the rotor 18'' rotates, the disc 116 is lightly rotated by action of the ring 124 on the cylinder 118. Accordingly, the cap 100' is rotated in abutting relationship to the disc 116.

As described above, the use of the spinning rotor in combination with the false-twisting spindle provides the following advantages:

First, as compared with conventional methods wherein each turn of the spinning rotor gives only one turn to the fibers, the method of the present invention makes it possible to give to the fibers a plurality of turns for each turn of the spinning rotor. In this manner, the rate of production of yarn can be substantially increased without any substantial increase in the rotational speed of the spinning rotor.

Second, the present invention permits a reduction in the rotational speed of the spinning rotor. Therefore, economies result in production of a product because of the reduced energy expended. Furthermore, in prior art methods, if the speed of rotation of the spindle is increased, the fiber arrangement is disturbed by the action of centrifugal force. This results in considerable fly loss and also results in instability of the spinning operation. Centrifugal force has been a source of great trouble in yarn formation. On the other hand, according to the present invention, the greater the effect of centrifugal force, the more is the spinning movement of the fiber ends. Accordingly, twisting efficiency increases with increased centrifugal force. Therefore, increased rotational speed of the rotor causes no problems whatsoever with respect to yarn formation. Quite to the contrary, such increased speed tends to improve results.

Third, by allowing the endless belt to move in contact with the rotor over a distance equivalent to the length of the fibers, it is possible that the extracted fibers are completely drawn from the bundle. It is also possible that the rear ends of the extracted fibers are separated from the bundle. In this manner, the method of the present invention is free of rear tuft problems. The extracted fibers are not caught in the yarn guide passages if the fiber material used is of relatively long length. Furthermore, tuft end wrapping around the periphery of the spinning rotor is avoided. These advantages permit a stable yarn formation.

As is apparent by reference to the preceding material, it can be seen that, in accordance with the present invention, it is possible to produce more efficiently spun yarns having real twist and having desirable yarn structure with less turbulence in fiber arrangement when compared to comparable ring-spun yarns.

In the broadest aspects of the present invention, any false twisting means can be employed, such as an air false-twisting system, a spindle system, a belt-nip system, a friction system or the like. However, the preferred false-twisting system is that employing a hollow spindle.

The invention may be better understood by reference to the following examples. These examples are designed to demonstrate the best mode for practicing the present invention.

EXAMPLE 1

Nylon slivers of seven denier having average fiber length of 152 mm and a unit weight of 3 g/m were spun into a spun yarn by employing the apparatus 10. In this process, the rotor 18 had a diameter of 100 mm. The rotor 18 was rotated at a speed of 1200 rpm. The length of contact "L" between the endless belt 48 and the rotor 18 was 160 mm. The minimum distance between the nip rollers 12,14 and the nip formed between the endless belt 48 and the boss 38 adjacent to the roller 50 was 160 mm. The false twister 64 was rotated at a speed of 10,800 rpm. The spinning velocity was set at 24 m/min.

The resulting yarn was a spun yarn comparable to Nm 1/5, with a real twist of 160 T/m. The yarn had a strength of 3,000 grams.

In this example, the twist efficiency, which is measured as the number of twists divided by the calculated number of twists times one hundred, was 57 percent. The yarn produced was of the worsted type.

EXAMPLE 2

The procedure of Example 1 was repeated employing the same conditions with the exceptions that: the apparatus 90 was employed; the diameter of the false twister 92 was 9 mm; the diameter "D" of the ring 98 was 81 mm; the spinning velocity was 30 m/min.

The resultant yarn was a spun yarn equivalent to Nm 1/6 with a real twist of 163 T/m. The yarn had a strength of 2800 grams. The twist efficiency was 73 percent.

Figure 13:
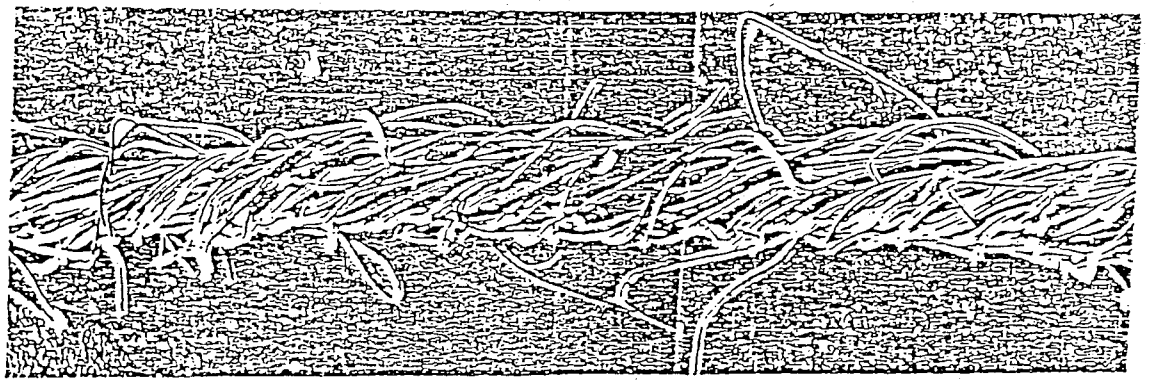
FIG. 13 (PRIOR ART)
FIG. 13 is an enlarged photographic view showing the structure of a spun yarn produced by a ring-traveler system which is not characteristic of the present invention but rather is characteristic of the prior art.
Figure 12:
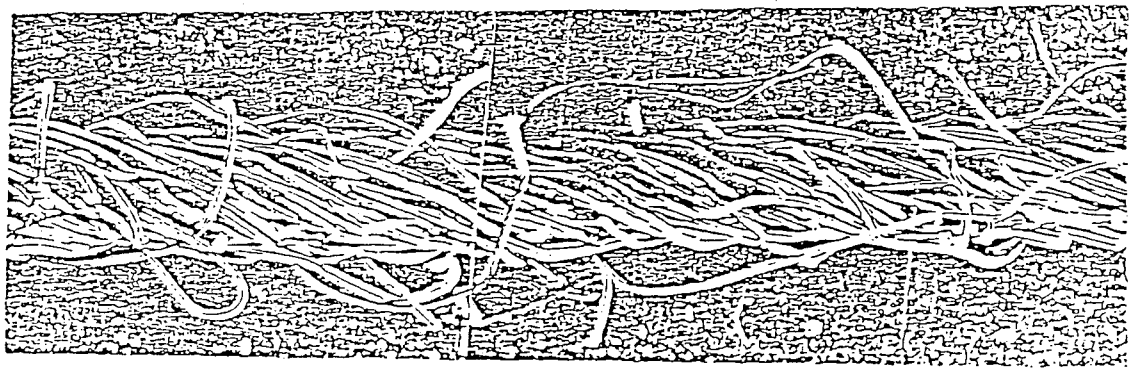
FIG. 12 is an enlarged photographic representation showing the structure of spun yarn produced by the apparatus of FIG. 5 of the present invention.

An enlarged photographic view showing the configuration of the spun yarn of the present invention compared to a ring-spun yarn is shown in FIG. 12 and 13. FIG. 12 shows the yarn produced in accordance with the present invention, whereas FIG. 13 shows a ring-spun yarn. As can be clearly seen, spun yarn produced by the method of the present invention has real twist which is substantially the same as ring-spun yarn, the only difference being in the direction of twist.

What is claimed is:

1. A method for producing a spun yarn having true twist, wherein the method employs a spinning rotor; said method comprising the steps of:

I. extracting staple fibers from a bundle of staple fibers; and

II. collecting the extracted staple fibers on the periphery of the spinning rotor; and III. recontacting the extracted fibers with the bundle of staple fibers to form a combined untwisted yarn; and IV. twisting the combined untwisted yarn to produce a twisted yarn; and V. false twisting the twisted yarn within the rotor; and VI. withdrawing the twisted yarn from the spinning rotor.

2. The method of claim 1 wherein the rotor has a ring-like configuration.

3. The method of claim 1 wherein the rotor has a disc-like configuration.

4. The method of claim 1 wherein the periphery of the rotor is greater than 1.1 times the mean length of the staple fibers.

5. An apparatus for producing a spun yarn having true twist; said apparatus comprising:

A. a rotor, spinnable about its axis; and

B. means for feeding a staple fiber bundle to the apparatus; and

C. means for extracting a small mass of staple fibers from the staple fiber bundle; and D. means, on the surface of the rotor, for containing the extracted staple fibers; and E. means for recombining the extracted staple fibers with the staple fiber bundle, and F. means for twisting the staple fiber bundle to produce a twisted yarn; and G. means, within the rotor, for false twisting the the twisted yarn to produce a spun yarn.

6. The apparatus of claim 5 further comprising a movable supporting means around the rotor.

7. The apparatus of claim 6 wherein the movable supporting means is an endless belt.

8. The apparatus of claim 7 wherein the length of contact between the surface of the rotor and the belt is greater than one inch.

9. The apparatus of claim 6 wherein a boss is provided on the outer surface of the rotor and a movable nip point is provided between the boss and the movable supporting means.

10. The apparatus of claim 5 wherein the false twisting means is a hollow tube.

11. An apparatus for producing spun yarn having both true twist and false twist; said apparatus comprising:

A. A first pair of nip rollers forming a first stationary nip:

wherein said nip rollers are adapted to contact a bundle of fibers and advance the bundle of fibers towards a rotor; and B. A rotor for receiving the bundle of fibers from the first pair of nip rollers:

wherein the rotor is adapted to rotate about its axis; and wherein the periphery of the rotor has two walls, each terminating in a cylindrical outer surface; and wherein the walls define an annular groove; and wherein the annular groove is interrupted by a boss having an outer yarn-engaging surface; and wherein a shaft is carried by the rotor and is adapted to be connected to a means for rotating the rotor; and wherein the rotor has a radial passage adjacent the boss in the direction of movement of the rotor; and wherein the radial passage is in communication with an axial passage which exits the rotor on the side of the rotor opposite the shaft; and C. An endless belt adapted to contact the cylindrical upper surface of both walls of the rotor thereby forming a fiber-tight chamber; and wherein the endless belt contacts the boss and forms an arcuately moving nip which moves from the first point of attachment between the boss and the endless belt to the last point of attachment between the boss and the endless belt; and wherein the length of contact of the endless belt and the boss is greater than the average length of the fibers of the bundle; and D. A casing having a cylindrical surface closely adjacent the cylindrical upper surface of the two walls of the rotor wherein the casing covers that portion of the periphery of the rotor which portion is free of the endless belt; and E. Means for imparting false twist to the yarn; which means is located downstream of the moving nip; and F. A second pair of nip rollers for withdrawing the spun yarn from the rotor; and wherein the annular groove, the endless belt, the cylindrical surface of the casing, and the boss together define a rotating fiber-tight chamber; and wherein contact between the boss and the endless belt extracts fibers from the bundle, leaving the fibers in the chamber; and wherein the fibers in the chamber subsequentially contact the fiber bundle after the fiber bundle leaves the first pair of nip rollers and before the fiber bundle contacts the endless belt.

12. An apparatus for producing spun yarn having both true twist and false twist; said apparatus comprising:

A. A first pair of nip rollers forming a first stationary nip:

wherein said nip rollers are adapted to contact a bundle of fibers and advance the bundle of fibers towards a rotor; and B. A rotor for receiving the bundle of fibers from the first pair of nip rollers:

wherein the rotor is adapted to rotate about its axis; and wherein the periphery of the rotor has two walls, each terminating in a cylindrical outer surface; and wherein the walls define an annular groove; and wherein the annular groove is interrupted by a boss having an outer yarn-engaging surface; and wherein a shaft is carried by the rotor and is adapted to be connected to a means for rotating the rotor; and wherein the rotor has a radial passage adjacent the boss in the direction of movement of the rotor; and wherein the radial passage is in communication with an axial passage which exits the rotor on the side of the rotor opposite the shaft; and C. An endless belt adapted to contact the cylindrical upper surface of both walls of the rotor thereby forming a fiber-tight chamber; and wherein the endless belt contacts the boss and forms an arcuately moving nip which moves from the first point of attachment between the boss and the endless belt to the last point of attachment between the boss and the endless belt; and wherein the length of contact of the endless belt and the boss is greater than the average length of the fibers of the bundle; and D. A casing having a cylindrical surface closely adjacent the cylindrical upper surface of the two walls of the rotor wherein the casing covers that portion of the periphery of the rotor which portion is free of the endless belt; and E. A false twister rotatably journaled within the axial passage with its axis of rotation coincidental with a radius of the rotor wherein the false twister is cylindrical and has a diameter less than that of the rotor; and wherein the outside of the false twister contacts a ring which causes the false twister to rotate about its axis when the rotor rotates about its axis; and F. A second pair of nip rollers for withdrawing the spun yarn from the rotor; and wherein the annular groove, the endless belt, the cylindrical surface of the casing, and the boss together define a rotating fibertight chamber; and wherein contact between the boss and the endless belt extracts fibers from the bundle, leaving the fibers in the chamber; and wherein the fibers in the chamber subsequentially contact the fiber bundle after the fiber bundle leaves the first pair of nip rollers and before the fiber bundle contacts the endless belt.

13. A method for producing a spun yarn having true twist, wherein the method employs a spinning rotor having an axial passage and a radial passage therein; said method comprising the steps of:

I. extracting staple fibers from a bundle of staple fibers; and on

II. collecting the extracted staple fibers on the periphery of the spinning rotor; and III. recontacting the staple fibers with the bundle of staple fibers to form a combined untwisted yarn; and IV. twisting the combined untwisted yarn to produce a twisted yarn; and V. false twisting the twisted yarn within the radial passage of the rotor to produce a spun yarn; and VI. withdrawing the spun yarn from the rotor through the axial passage of the rotor.

14. An apparatus for producing a spun yarn having true twist; said apparatus comprising:

A. a rotor, spinnable about its axis, said rotor having a radial passage and an axial passage therein; and B. means for feeding a staple fiber bundle to the apparatus; and C. means for extracting a small mass of staple fibers from the staple fiber bundle; and D. means, on the surface of the rotor, for containing the extracted staple fibers; and E. means for recombining the extracted staple fibers with the staple fiber bundle; and F. means for false twisting the staple fiber bundle to produce a spun yarn, said false twisting means being provided in the radial passage of the rotor; and G. means for withdrawing the spun yarn from the rotor through the axial passage in the rotor.

* * * * *